US007204269B2

(12) United States Patent
Alwes et al.

(10) Patent No.: US 7,204,269 B2
(45) Date of Patent: Apr. 17, 2007

(54) ARTICULATED MAST FOR MOVABLE CONCRETE PUMPS

(75) Inventors: Dieter Alwes, Aichtal (DE); Markus Wolfram, Nürtingen (DE)

(73) Assignee: Putzmeister Aktiengesellschaft, Aichtai (DE)

( * ) Notice: Subject to any disclaimer, the term of this patent is extended or adjusted under 35 U.S.C. 154(b) by 194 days.

(21) Appl. No.: 10/529,456

(22) PCT Filed: Jun. 4, 2004

(86) PCT No.: PCT/EP2004/006025

§ 371 (c)(1),
(2), (4) Date: Mar. 28, 2005

(87) PCT Pub. No.: WO2004/113647

PCT Pub. Date: Dec. 29, 2004

(65) Prior Publication Data

US 2006/0137750 A1 Jun. 29, 2006

(30) Foreign Application Priority Data

Jun. 25, 2003 (DE) ..... 103 28 769

(51) Int. Cl.
*B67D 5/64* (2006.01)

(52) U.S. Cl. ..... 137/615; 141/387

(58) Field of Classification Search ..... 137/615; 141/387

See application file for complete search history.

(56) References Cited

U.S. PATENT DOCUMENTS 4,828,033 A * 5/1989 Frison ..... 137/615
5,535,780 A * 7/1996 Schlecht et al. ..... 137/615

* cited by examiner

*Primary Examiner*—Kevin Lee
(74) *Attorney, Agent, or Firm*—Akerman & Senterfitt; Stephan A. Pendorf

(57) ABSTRACT

A mobile concrete pump comprising at least five mast arms (1 to 7) which are pivotable relative to each other about horizontal rotation axes (B to G). The first respective mast arm is hinged to a mast block (22) so as to be pivotable about a horizontal rotation axis (A), said mast block being rotatable about a vertical axis (20), while one end of the last mast arm has no joint. In order to be able to add other mast arms in a modular manner, a first Z-type folding group comprising the last three mast arms, a first coil-type folding group comprising the penultimate, third to last and fourth to last mast arm, and a second Z-type folding group comprising the third to last, fourth to last, and fifth to last mast arm are provided in a preferred embodiment. The basic configuration can be complemented with additional mast arms by having a sixth to last mast arm form a Z-type folding group consisting of four mast arms along with the third to last, fourth to last, and fifth to last mast arm while a seventh to last mast arm forms a second coil-type folding group together with the fifth to last and sixth to last mast arm.

15 Claims, 6 Drawing Sheets

A
B
C
D
10
12
14
16
18
20
22
24/5
24/6
24/7
26
28
30
32
34
36
38
40
42
44

42''
32
3''/2'/1
2''/1'
28
26
24/7
1''
22

D/180°
B/270°
F/250°
Arm 2
Arm 4
Arm 6
Arm 3
Arm 7
Arm 5
Arm 1
C/270°
G/210°
E/180°
A/90°
22
24/7

28
10
24/7
3''/2'/1
2''/1'
1''

ARTICULATED MAST FOR MOVABLE CONCRETE PUMPS

CROSS REFERENCE TO RELATED APPLICATION

This application is a national stage of PCT/EP2004/006025 filed Jun. 4, 2004 and based upon DE 103 28 769.8 filed Jun. 25, 2003 under the International Convention.

BACKGROUND OF THE INVENTION

1. Field of the Invention

The invention concerns an articulated boom for a mobile concrete pump comprising at least five mast arms pivotable relative to each other about horizontal rotation axes, wherein the first respective mast arm is articulated to a mast stand so as to be pivotable about a horizontal rotation axis (A), said mast stand being rotatable about a vertical axis, the last mast arm having no articulation joint, wherein the mast arms can be folded relative to each other in groups in the manner of a Z-fold or a coil-type fold for transport purposes.

2. Related Art of the Invention

A concrete distribution mast of this type is known (DE-B-3446290), wherein all mast arms can be folded against each other about their articulation axes in the manner of a Z-fold. This concrete distribution mast has a great reach and can be employed both in low construction sites as well as in high-rises. The Z-folding makes possible a rapid operational deployment, even after the short lifting of the only partially unfolded packet of arms, and a high flexibility, in particular during concretizing of difficult to access locations, wherein dead space is substantially avoided both in awkward conveyance near to the vehicle as well as in concretizing in low spaces. The concretizing parallel to the work plane is possible with the multi-Z-fold. A bringing of the end hose close to the operator cabin is, however, achieved only at the expense of a relatively high unfolding height.

Further, a five-arm concrete distribution boom is known (WO 94/08111), of which mast arms 1, 2, and 3 are foldable against each other in the manner of a Z-fold while mast arms 3, 4, and 5, on their linkages D and E respectively in the same sense as mast arms 2 and 3 in the area of their articulation linkage C, are foldable against each other in the manner of a coil-fold. This mast configuration can be employed both in planar low spaces with overcoming of obstacles, as well as in high floors for concretizing with parallel hose guidance, and low fold out height.

The previously known mast configurations are so conceptualized, that they can be provided on a multi-axle vehicle chassis with extended rigid frame or on an articulated tractor-trailer. Motor vehicle regulations regulate the length and height of motor vehicles, which regulations stand in the way of a further increase of the range of the distribution mast.

SUMMARY OF THE INVENTION

Beginning therewith, it is the task of the present invention to develop an articulated mast which, while maintaining permissible axle loads and vehicle heights in the transport condition of a mobile concrete pump, makes possible a significant increase in range.

For the solution of this task, a mobile concrete pump is provided comprising at least five mast arms (1 to 7) which are pivotable relative to each other about horizontal pivot axes (B to G) is provided, wherein the respective first mast arm (1) is hinged to a mast block (22) so as to be pivotable about a horizontal pivot axis (A), said mast block being rotatable about a vertical axis (20), while the end of the last mast arm has no articulated joint, and wherein the mast arms can be folded in groups relative to each other in the manner of a Z-fold or a coil-type fold for transport purposes, characterized by a first Z-type folding group comprising the last three mast arms, a first coil-type folding group comprising the penultimate, third to last and fourth to last mast arms, and a second Z-type folding group comprising the third to last, fourth to last, and fifth to last mast arms and a mobile concrete pump comprising at least six mast arms (1 to 7) which are pivotable relative to each other about horizontal pivot axes (B to G) is provided, wherein the respective first mast arm (1) is hinged to a mast block (22) so as to be pivotable about a horizontal pivot axis (A), said mast block being rotatable about a vertical axis (20), while the end of the last mast arm has no articulated joint, and wherein the mast arms can be folded in groups relative to each other in the manner of a Z-fold or a coil-type fold for transport purposes, characterized by a first Z-type folding group comprising the last four mast arms, a first coil-type folding group comprising the third to last, fourth to last and fifth to last mast arms, and a second Z-type folding group comprised of the fourth to last, fifth to last and sixth to last mast arms. Advantageous embodiments and further developments of the invention can be seen from the dependent claims.

The inventive solution is based upon the idea that by a suitable start in folding of individual mast groups of the articulated mast a modular type add-on or expansion by additional mast arms is made possible, which makes possible a suitable transport folding for two-part vehicles.

In order to accomplish this, there is provided in accordance with a first inventive embodiment a first Z-folding group, comprised of the three last mast arms, a first coil-folding group, comprised of the penultimate, third to last and fourth to last mast arms and a second Z-folding group, comprised of the third to last, fourth to last, and fifth to last mast arms. This basic configuration can supplementally include a sixth to last mast arm, which forms, together with the third to last, fourth to last, and fifth to last mast arms, a Z-folding group comprised of four mast arms. Besides this, a seventh mast arm can be provided, which together with the fifth to last and sixth to last mast arms forms a second coil-folding group.

According to a further inventive embodiment, a first Z-folding group, comprised of the four last mast arms, a first coil-folding group comprised of the third to last, fourth to last, and fifth to last mast arms and a second Z-folding group, comprised of the fourth to last, fifth to last, and sixth to last mast arms, is provided. This configuration can supplementally include a seventh mast arm, which together with the fifth to last and sixth to last mast arms forms a second coil-folding group.

According to an advantageous embodiment of the invention, the pivot range of the last and the penultimate linkage is at least 200°, wherein the pivot range of the penultimate linkage is preferably at least 260°. A further advantageous embodiment of the invention envisions that the pivot range of the third to last and fourth to last linkages comprises 170° to 270°, while the pivot range of the fifth to last and/or sixth to last linkage should comprise 240° to 280°. On the first linkage, the first mast arm of the articulated mast should exhibit a pivot range of at least 90°, wherein the upper limit lies at 180° due to the rotatability of the mast base about a vertical axis.

BRIEF DESCRIPTION OF THE DRAWINGS

In the following, the invention will be described in greater detail on the basis of the illustrative embodiments shown schematically in the figures. There is shown FIGS. 1*a*, 2*a*, and 3*a* three side views of mobile concrete pumps with five arm, six arm and seven arm articulated masts.

DETAILED DESCRIPTION OF THE INVENTION

Figures 1A, 2A, 3A:
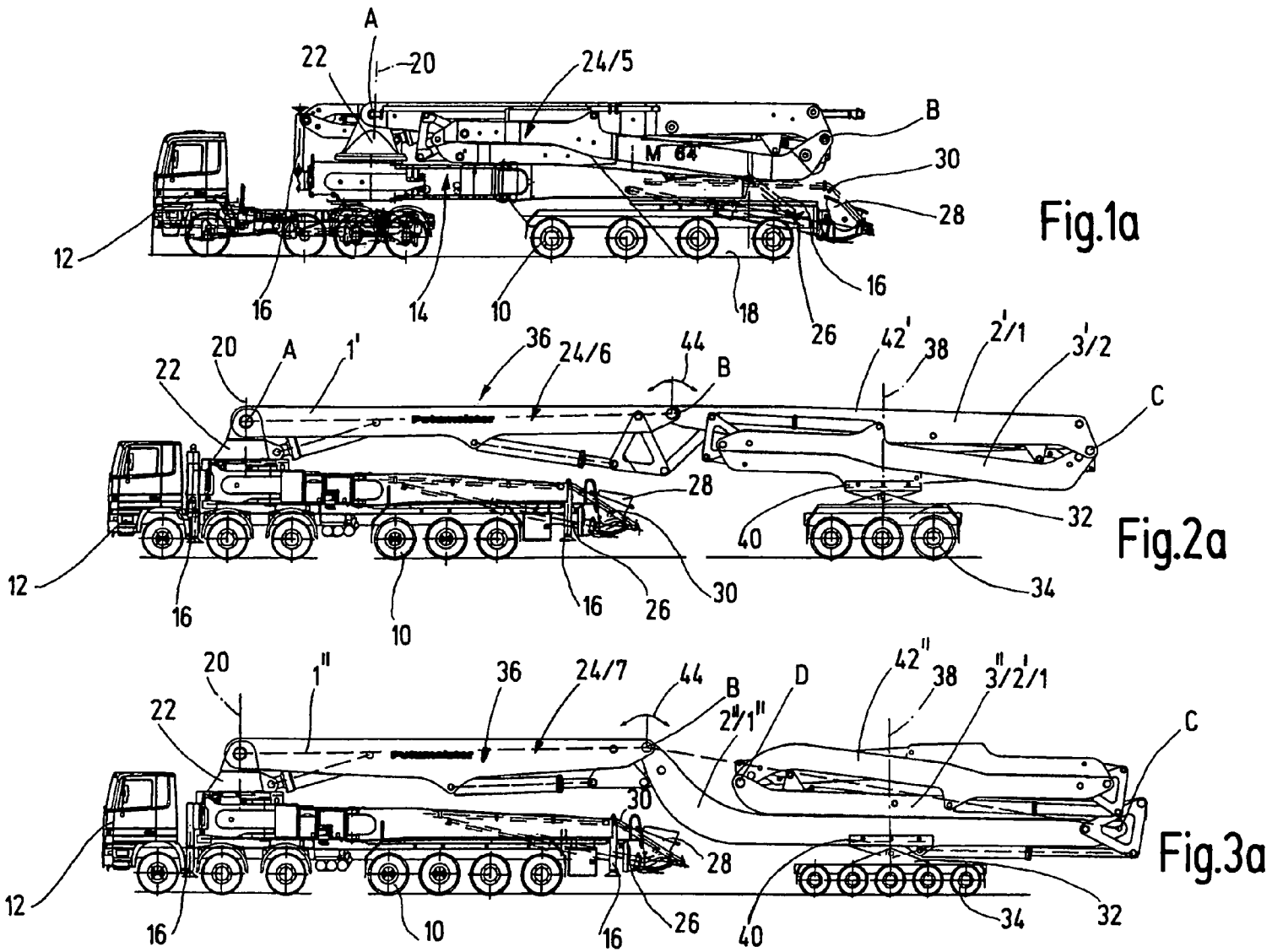
FIGS. 1*b* and 1*c* an enlarged representation of the mobile concrete pump according to FIG. 1*a* as well as a folding schematic of the articulated mast in the transport position.
FIGS. 2*b* through 2*d* a side view of the mobile concrete pump according to FIG. 2*a* in the transport condition and in the condition of being mobile on the construction site, as well as folding schematic of the articulated mast in the condition of being mobile on the construction site according to FIG. 2*c;*
FIGS. 3*b* through 3*d* a side view of the mobile concrete pump according to FIG. 3*a* in the condition of the transport and in the condition of mobility on the construction site, as well as folding schematic of the articulated mast in the condition of being mobile on the construction site according to FIG. 3*c;*

The mobile concrete pumps shown in the figures have a building frame 14 mounted on the truck chassis 12 of a chassis frame 10, which is supportable upon the ground 18 via support outriggers 16 with lifting up of the chassis frame. The building frame includes a mast block 22 rotatable about a vertical axis of the chassis frame 10, which mast block carries a concrete distribution mast 24 in the form of a multi-element articulated mast. The articulated mast includes a first mast arm 1 pivotable at a first articulation linkage A with horizontal articulation axis relative to mast block 22 and additional articulation linkages D through E (FIGS. 1*a* through 1*d*) or B through F (FIGS. 2*a* through 2*d*) or B through G (FIGS. 3*a* through 3*d*). Mast arms 2 through 5 or 2 through 6 or 2 through 7 are pivotable relative to each other about horizontal articulation axes.

On the vehicle chassis, the building frame 14 additionally carries a pump unit 26 in the form of a two cylinder thick matter pump, which operates according to the principle of a tandem pump and respectively, in a suction stroke, sucks a concrete column out of a material supply container 28 and, in a subsequent pressure stroke, conveys to a concrete conveyance conduit comprised of a pressure pipe 30 and a number of concrete conveyance pipes. Via the conveyance line, which passes through the rotatable mast block 22 and runs with its not shown concrete conveyance pipes parallel to the mast arms and is rigidly connected therewith, the concrete is pumped to the desired concretizing location.

In the transport condition, the mast arms must be so folded together and positioned upon the vehicle chassis that the vehicle length and vehicle height, according to the prescription of the traffic regulations, is not exceeded.

In the embodiment shown in FIGS. 2 through 5, the mobile concrete pump, when in the condition of street transport, exhibits, besides the vehicle chassis 10 carrying the construction frame 14, a trailer 32, which has its own chassis 34 and, via a coupling element 36, is connected to the vehicle chassis 10. The trailer has a carrier stool 40 rotatable about the vertical axis 38 relative to the chassis of the trailer, upon which the arm packet 42 projecting beyond the rear end of the vehicle chassis 10 in the transport condition is supportable. The arm packet 42 is comprised of the second mast arm 2 folded out about the second articulation linkage B relative to the first mast arm 1 and the remaining mast arms 3 through 6, or as the case may be, 3 through 7 in the folded together position relative to the second mast arm 2, and forms, together with the first mast arm 1, the coupling element 36 between vehicle chassis 10 and trailer 32. The trailer 32 is self-steering. The steering device of the trailer 32 is preferably electronically coupled with a steering device of the vehicle chassis 10 so that between vehicle chassis 10 and trailer 32 a coordinated driving around curves is made possible. The vertical axes 20 and 38 of the mast block 22 and the carrier stool 40 are free rotation axes of the coupling elements 36 in the condition of street transport. As indicated by the double arrow 44 and FIGS. 2*a* and 3*a*, in the condition of the street transport, the second articulated linkage B is freely pivotable about its articulation axis. In the decoupled condition, the arm packet 42 comprised of mast arms 2 through 6, or as the case may be, 2 through 7 may be folded against the first mast arm 1 and alone be laid upon the vehicle chassis 10 (2*c*, 3*c*, 4*b*, 5*b*). When in the condition of the street transport according to FIGS. 2*b*, 3*b*, 4*b*, and 5*b*, already a maximal vehicle height has been reached, then after the additional folding in of the arm packet 42 a vehicle height exceeding that permissible on the street is produced, which height is permissible only on the private construction site (thus referred to herein as the condition of construction area transport).

In the operating condition, care must be taken that the vehicle chassis is sufficiently supported with its support outriggers 16. An improvement in this regard can be achieved by driving or lifted the trailer 32 in the uncoupled condition onto the vehicle chassis 10 as ballast.

FIGS. 1*a*, 2*a*, and 3*a* show that by a modular construction of the distribution boom, with relatively simple means, with utilization of the same arm components, a transition can be made beyond a five arm (FIG. 1*a*), beyond a six arm (2*a*) to a seven arm (3*a*) distribution boom.

The starting point is the construction shown in FIG. 1*a*, comprised of a first articulated truck with a five arm distribution boom 24/5 for a range of approximately 60 m. The use of an articulated truck in the building of a mobile concrete pump is the subject of EP-B-0038954.

If the arm packet 42 shown in FIG. 1*a* is enhanced by an additional mast arm 1, then one arrives at the six arm mast configuration shown in FIG. 2*a*, of which arm packet 42 in the condition of street transport is supported on a three-axle trailer 42. The previous arms 1, 2, 3, etc. become new arms 2', 3', 4'. In FIG. 2*a*, this is indicated by the arm reference numbers 2'/1, 3'/2, 4'4, etc. The range of the distribution boom 24 is increased by the additional arm 1' to approximately 70 m.

If one folds the total articulated mast according to FIG. 2*a* together and turns it about 180°, then one obtains an arm packet 42", which can be increased by a new mast arm 1". The arm 2" in FIG. 3*a* must be geometrically adapted (bent) relative to arm 1' in FIG. 2*a*. The previous arms 2", 3", 4", etc. now become arms 3", 4", 5", etc. In FIG. 3*a*, this is indicated by arm reference numbers 3"/2'/1, 4"/3'/2, etc. The six arm packet 42" is supported on a five axle trailer 32. The result according to FIG. 3*a* is a seven arm distribution mast 24/7 with a range of approximately 80 m.

Figure 1B:
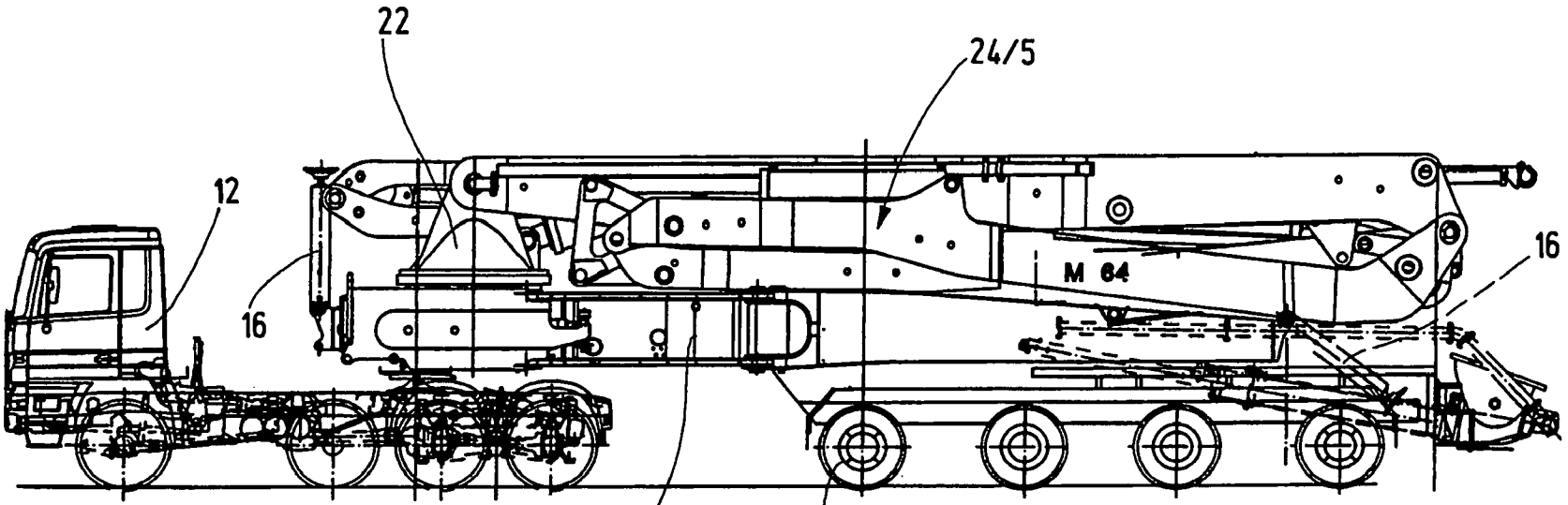
Figure 1C:
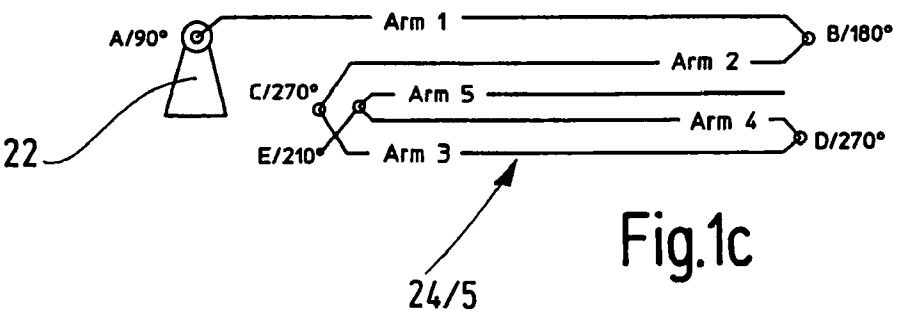

The folding schematic of the five arm distribution mast according to FIG. 1*a* can be found beside the representation in the condition of the street transporter according to FIG. 1*b* in FIG. 1*c*. The arms 1, 2, and 3 are there folded in the Z-manner, while the arm group 3, 4, and 5 are folded in the manner of a coil-fold.

Figure 2B:
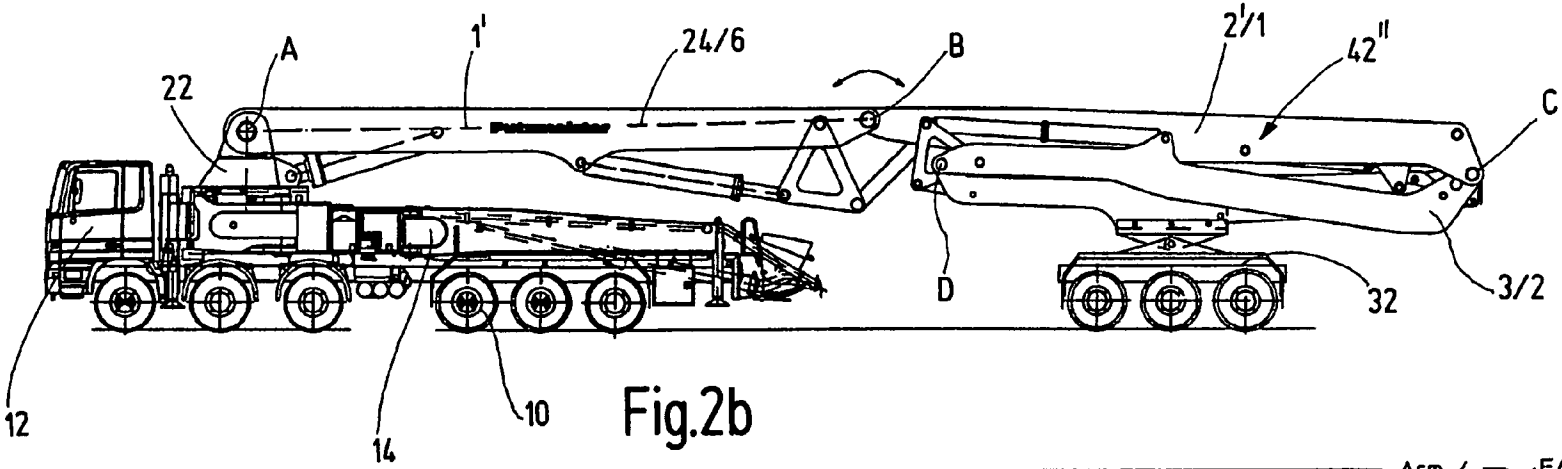
Figure 2D:
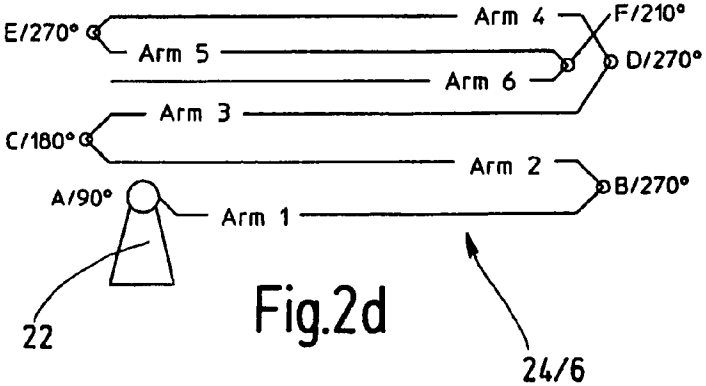
Figure 2C:
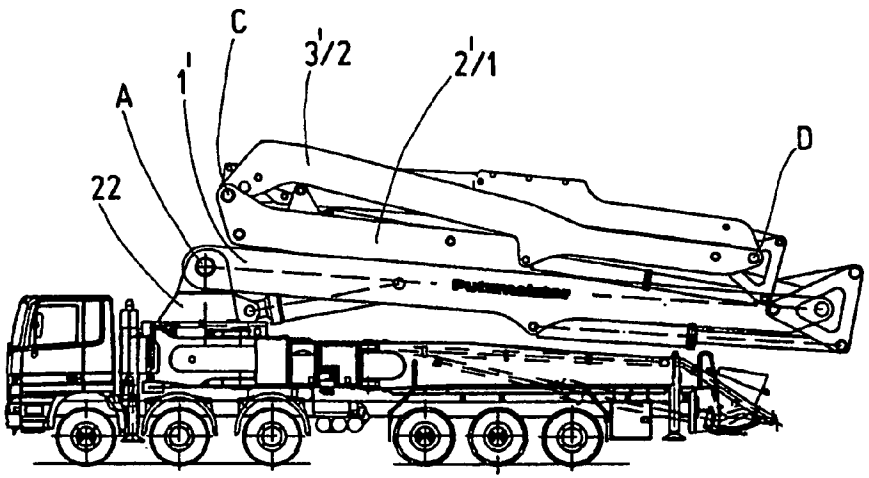

The folding schematic of the six arm distribution mast according to FIG. 2*a* can be found beside the representation in the condition of the street transport and the construction site transport (FIGS. 2*b* and 2*c*) in FIG. 2*d*. The arms 1, 2, and 3, and the arms 4, 5, and 6 are there folded in the Z-manner, while the arm group 3, 4, and 5 are folded in the manner of a coil-fold.

Figures 3B, 3C, 3D:
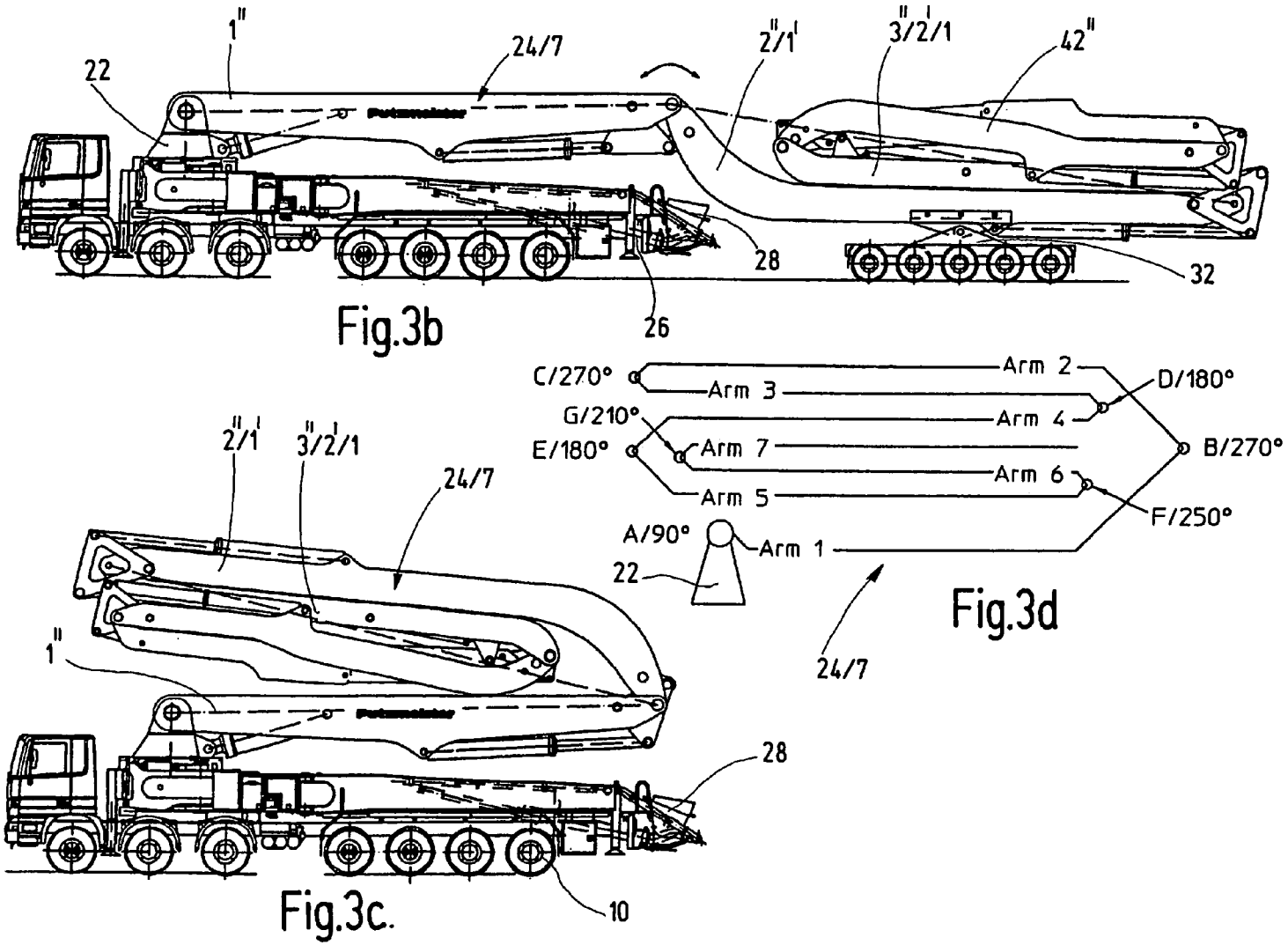
Figure 4A:
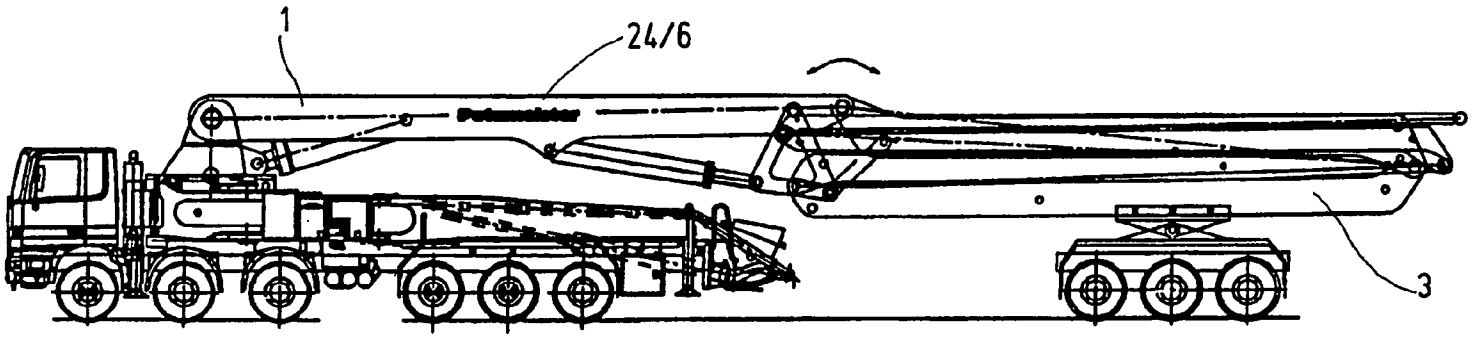
FIGS. 4*a* through 4*c* a side view of the mobile concrete pump with a six arm articulated mast in the condition of the transport and in the condition of construction site mobility as well as folding schematic of the articulated mast in the condition of the construction site mobility according to FIG. 4*b;*
Figure 4C:
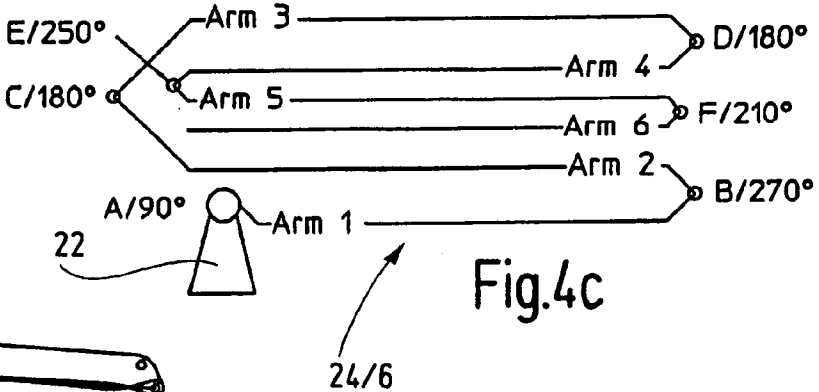
Figure 4B:
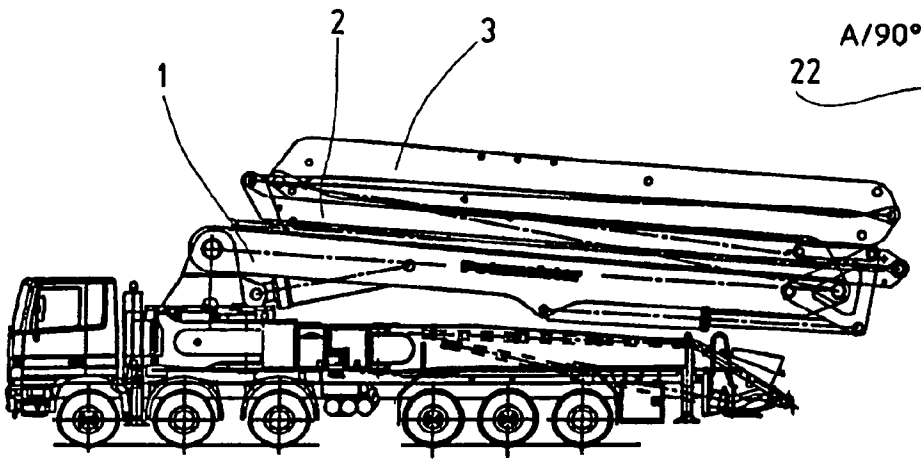
Figure 5A:
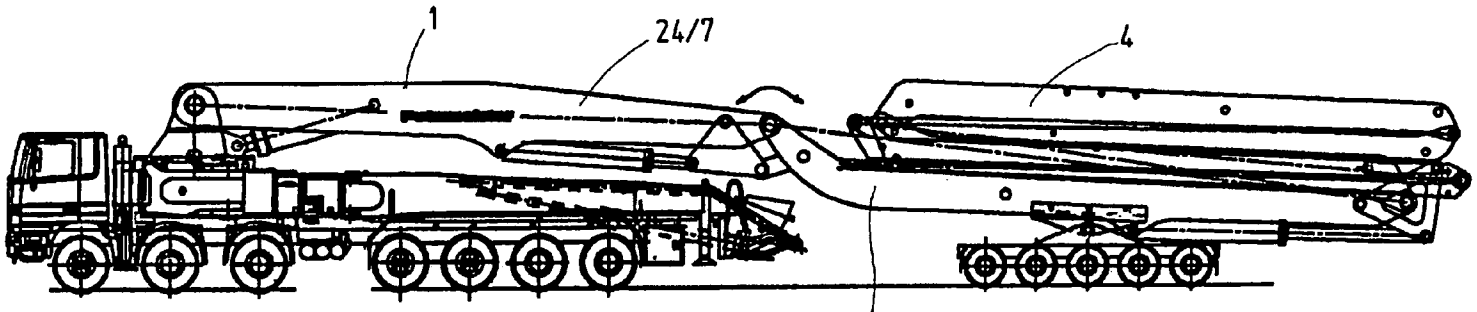
FIGS. 5*a* through 5*c* a side view of the mobile concrete pump with a seven arm articulated mast in the condition of transport and in the condition of construction site mobility as well as folding schematic of the articulated mast in the condition of the construction site mobility according to 5*b*.
Figure 5C:
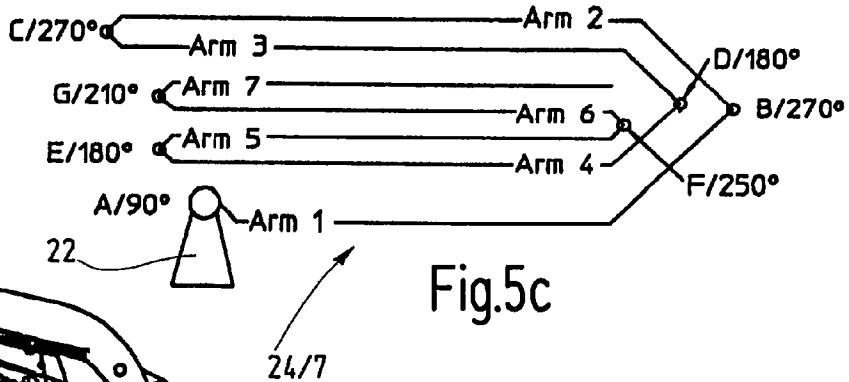
Figure 5B:
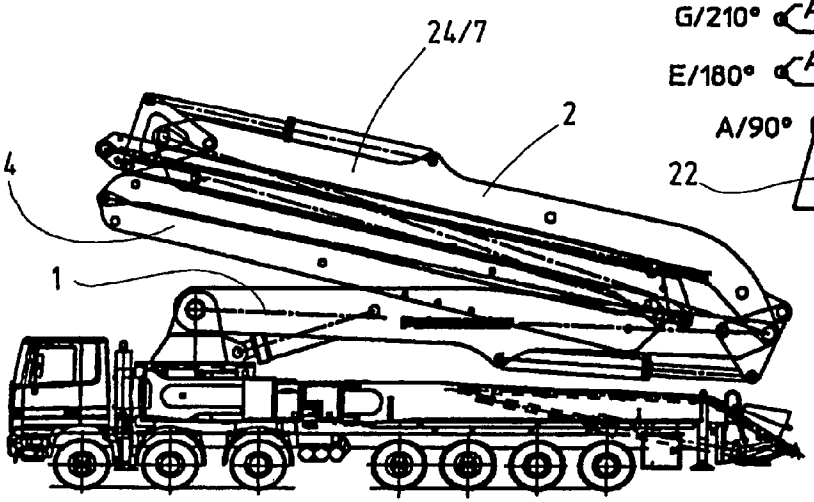

The seven arm mast configurations shown in 3*a* through 3*d* and 5*a* through 5*c* differ essentially in the start folding of the individual mast groups:

| | | |
|---|---|---|
| FIG. 3d: | Arm 1, 2, 3: | Coil-fold |
| | Arm 2, 3, 4: | Z-fold |
| | Arm 3, 4, 5: | Coil-fold |
| | Arm 4, 5, 6, 7: | Z-fold |
| FIG. 5c: | Arm 1, 2, 3: | Coil-fold |
| | Arm 2, 3, 4, 5: | Z-fold |
| | Arm 4, 5, 6: | Coil-fold |
| | Arm 5, 6, 7: | Z-fold |

Reference is especially made to the pivot angles, which are provided for linkages A through G, or as the case may be, A through F, or as the case may be A through G, in FIGS. 1*c*, 2*d*, 3*d*, 4*c*, and 5*c*.

In summary, the following can be concluded: The invention concerns a mobile concrete pump comprising at least five mast arms (1 to 7) which are pivotable relative to each other about horizontal rotation axes (B to G). The first respective mast arm is hinged to a mast block (22) so as to be pivotable about a horizontal rotation axis (A), said mast block being rotatable about a vertical axis (20), while one end of the last mast arm has no joint. In order to be able to add other mast arms in a modular manner, a first Z-type folding group comprising the last three mast arms, a first coil-type folding group comprising the penultimate, third to last and fourth to last mast arm, and a second Z-type folding group comprising the third to last, fourth to last, and fifth to last mast arm are provided in a preferred embodiment. The basic configuration can be complemented with additional mast arms by having a sixth to last mast arm form a Z-type folding group consisting of four mast arms along with the third to last, fourth to last, and fifth to last mast arm while a seventh to last mast arm forms a second coil-type folding group together with the fifth to last and sixth to last mast arm.

The invention claimed is:

1. A mobile concrete pump comprising a mast block rotatable about a vertical axis (20), at least five mast arms (1 to 7) which are pivotable relative to each other about horizontal pivot axes (B to G), and including a first mast arm and a last mast arm, wherein the first mast arm (1) is hinged to the mast block (22) so as to be pivotable about a horizontal pivot axis (A), while the end of the last mast arm has no articulated joint, and wherein the mast arms can be folded in groups relative to each other in the manner of a Z-fold or a coil-type fold for transport purposes, including a first Z-type folding group comprising the last three mast arms, a first coil-type folding group comprising the penultimate, third to last and fourth to last mast arms, and a second Z-type folding group comprising the third to last, fourth to last, and fifth to last mast arms.

2. The mobile concrete pump according to claim 1, wherein a sixth to last mast arm, along with the third to last, fourth to last, and fifth to last mast arms, form a Z-type folding group consisting of four mast arms.

3. The mobile concrete pump according to claim 1 wherein a seventh to last mast arm forms a second coil-type folding group together with the fifth to last and sixth to last mast arms.

4. The mobile concrete pump according to claim 1, wherein the pivot range of the last and penultimate linkage is at least 200°.

5. The mobile concrete pump according to claim 1, wherein, the pivot range of the penultimate linkage is at least 260°.

6. The mobile concrete pump according to claim 1, wherein the pivot range of the third to last and fourth to last linkage is 170° to 270°.

7. The mobile concrete pump according to claim 1, wherein the pivot range of the fifth to last and sixth to last linkage is 240° to 280°.

8. The mobile concrete pump mast according to claim 1, wherein the pivot range of the first linkage (A) is 90° to 180°.

9. A mobile concrete pump comprising a mast block rotatable about a vertical axis (20), at least six mast arms (1 to 7) which are pivotable relative to each other about horizontal pivot axes (B to G), including a first mast arm and a last mast arm, wherein the first mast arm (1) is hinged to the mast block (22) so as to be pivotable about a horizontal pivot axis (A), while the end of the last mast arm has no articulated joint, and wherein the mast arms can be folded in groups relative to each other in the manner of a Z-fold or a coil-type fold for transport purposes, including a first Z-type folding group comprising the last four mast arms, a first coil-type folding group comprising the third to last, fourth to last and fifth to last mast arms, and a second Z-type folding group comprised of the fourth to last, fifth to last and sixth to last mast arms.

10. The mobile concrete pump according to claim 9, wherein a seventh to last mast arm forms a second coil-type folding group together with the fifth to last and sixth to last mast arms.

11. The mobile concrete pump according to claim 9, wherein the pivot range of the last and penultimate linkage is at least 200°.

12. The mobile concrete pump according to claim 9, wherein the pivot range of the penultimate linkage is at least 260°.

13. The mobile concrete pump according to claim 9, wherein the pivot range of the third to last and fourth to last linkage is 170° to 270°.

14. The mobile concrete pump according to claim 9, wherein the pivot range of the fifth to last and sixth to last linkage is 240° to 280°.

15. The mobile concrete pump according to claim 9, wherein the pivot range of the first linkage (A) is 90° to 180°.

* * * * *